US010126016B2

(12) United States Patent
Kim

(10) Patent No.: US 10,126,016 B2
(45) Date of Patent: Nov. 13, 2018

(54) HEATER FOR INDOOR WARMING USING WASTE HEAT OF EXHAUST GAS

(71) Applicant: Jeong Sub Kim, Gyeonggi-do (KR)

(72) Inventor: Jeong Sub Kim, Gyeonggi-do (KR)

( * ) Notice: Subject to any disclaimer, the term of this patent is extended or adjusted under 35 U.S.C. 154(b) by 285 days.

(21) Appl. No.: 14/909,656

(22) PCT Filed: Aug. 8, 2014

(86) PCT No.: PCT/KR2014/007383
§ 371 (c)(1),
(2) Date: Feb. 2, 2016

(87) PCT Pub. No.: WO2015/133686
PCT Pub. Date: Sep. 11, 2015

(65) Prior Publication Data

US 2016/0187026 A1 Jun. 30, 2016

(30) Foreign Application Priority Data

Mar. 6, 2014 (KR) ..... 10-2014-0026739

(51) Int. Cl.
*F28D 21/00* (2006.01)
*F23J 11/00* (2006.01)
(Continued)

(52) U.S. Cl.
CPC ..... *F24H 3/08* (2013.01); *F23J 11/00* (2013.01); *F24C 1/00* (2013.01); *F24H 3/087* (2013.01);
(Continued)

(58) Field of Classification Search
CPC ..... F24B 7/005; F24D 11/005; F24D 2200/18
See application file for complete search history.

(56) References Cited

U.S. PATENT DOCUMENTS 3,844,233 A * 10/1974 Fishback ..... C21B 7/005 110/119
4,171,089 A * 10/1979 Schossow ..... F23L 15/04 126/112
(Continued)

FOREIGN PATENT DOCUMENTS

JP 2007187392 A 7/2007
KR 1020040067688 A 7/2004
(Continued)

OTHER PUBLICATIONS

International Search Report dated Oct. 20, 2014 from corresponding International Application No. PCT/KR2014/007383; 5 pgs.

*Primary Examiner* — Avinash Savani
*Assistant Examiner* — Deepak Deean
(74) *Attorney, Agent, or Firm* — Paratus Law Group, PLLC

(57) ABSTRACT

A fan heater for heating using exhaust waste heat, including: a natural exhaust tube discharging some exhaust gas from a water heater; a forced exhaust tube connected to the natural exhaust tube in a parallel structure, the remaining exhaust gas, excluding naturally discharged exhaust gas, flowing into the forced exhaust tube; a heat exchange device on the upper portion of the forced exhaust tube and supplied with high-temperature exhaust gas; a forced exhaust blower installed on the heat exchange device to draw exhaust gas from the forced exhaust tube and discharge it; a main unit having the heat exchange device embedded therein and having a circulation unit such that low-temperature indoor air circulates into the heat exchange device; a warm-air circulation blower supplying the indoor air towards the outer air circulation unit and circulating the low-temperature indoor air so the exhaust gas exchanges heat; and a control unit.

6 Claims, 7 Drawing Sheets

(51) Int. Cl.

| | |
|---|---|
| ***F24H 3/08*** | (2006.01) |
| ***F24H 9/20*** | (2006.01) |
| ***F24C 1/00*** | (2006.01) |

(52) U.S. Cl.
CPC ..... *F24H 9/2085* (2013.01); *F28D 21/0003* (2013.01); *F28D 21/0008* (2013.01); *F23N 2033/02* (2013.01); *F23N 2035/04* (2013.01); *F24D 2200/18* (2013.01)

(56) References Cited

U.S. PATENT DOCUMENTS

| | | | | | |
|---|---|---|---|---|---|
| 4,185,685 | A * | 1/1980 | Giberson | F28D 21/0007 | 110/162 |
| 4,331,199 | A * | 5/1982 | Dehue | F28D 21/0007 | 122/20 B |
| 4,450,901 | A * | 5/1984 | Janssen | F23J 15/06 | 122/20 B |
| 5,394,860 | A * | 3/1995 | Borle | F24D 12/02 | 126/110 A |
| 5,858,045 | A * | 1/1999 | Stemmer | B01D 46/0036 | 55/486 |
| 2006/0240369 | A1 * | 10/2006 | Duesel, Jr. | F23G 7/08 | 431/5 |

FOREIGN PATENT DOCUMENTS

| | | | |
|---|---|---|---|
| KR | 2003397963 | Y1 | 10/2005 |
| KR | 1020110119499 | A | 11/2011 |

* cited by examiner

HEATER FOR INDOOR WARMING USING WASTE HEAT OF EXHAUST GAS

TECHNICAL FIELD

The present invention relates to a heater for indoor warming using waste heat of exhaust gas. In more particular, the present invention relates to a heater for indoor warming using waste heat of exhaust gas which includes a forced exhaust pipe parallelly connected with a natural exhaust pipe of a water heater and causes indoor air to be heat-exchanged with exhaust gas introduced through the forced exhaust pipe and then feeds the heat-exchange indoor air back and thus can produce warm air without separate consumption of fuel for feeding the warm air indoors, thereby saving cost for heating by warm air and sharply saving cost for installing of facilities and cost for maintenance and which can minimize the consumption of power by disposing a temperature-sensing unit for sensing a temperature of the exhaust gas in the natural exhaust pipe and automatically operating and stopping a blower for forced exhaust and a blower for circulation of warm air depending on the temperature of the exhaust gas.

BACKGROUND ART

In general, a warm air-using heating apparatus for increasing indoor temperature by feeding warm air to facilities has great heat loss due to exhaust gas combusted in a heater and discharged therefrom and residual heat, and has a risk of fire due to high temperature and a safety problem due to user's carelessness. Furthermore, a water heater for indoor warming lacks a technical way of re-using indoor air as warm air by using waste heat of the exhaust gas and therefore it is difficult to effectively use the waste heat of the exhaust gas.

In this connection, Korean Laid-Open Patent Application No. 2009-0098431 discloses a warm-air heater having waste heat-recovering means as illustrated in FIG. 1.

In more particularly, the warm-air heater includes a main body (110) having a warm air-discharging port and a conduit (112); a combustion chamber (120) provided within the main body (110); a burner (130) installed on the main body (110); a heat exchange pipe unit (140) for heat exchange with hot combustion gas; and a blower (150) provided for generation and discharge of the warm air, wherein provided at an end of the heat exchange pipe unit (140) is a waste heat-recovering chamber (162) which allows inflow and outflow of the combustion gas, and the waste heat-recovering chamber (162) houses waste heat-recovering pipes (161) connected with a make-up water tank (163), which pipes can feed the make-up water or heat medium fluid, and heat-emitting pipes (171) connected with the waste heat-recovering pipes (161) by a connection pipe (181), and a circulation pump (182) is installed on the connection pipe (181) connecting the waste-heat recovering pipes (161) with the heat-emitting pipes (171), and thus the make-up water or heat medium fluid filled in the waste heat-recovering pipes (161) is forcedly circulated via the heat-emitting pipes (171).

However, according to the document of prior art described above, the warm-air heater has a problem that it is difficult to install due to its complex structure and has no economic efficiency, and moreover, is too large and too complex to install also for application in heating by warm air, therefore, is remarkably inferior in economic efficiency Document of prior art (Patent Document 1): Korean Laid-Open Patent Application No. 2009-0098431

SUMMARY OF THE INVENTION

Technical Problems

In order to solve the above-mentioned problems, an object of the present invention is to provide a heater for indoor warming using exhaust waste heat which includes a forced exhaust pipe parallelly connected with a natural exhaust pipe of a water heater and causes indoor air to be heat-exchanged with exhaust gas introduced through the forced exhaust pipe and then feeds the heat-exchange indoor air back and also supplies warm air without separate consumption of fuel for producing the warm air and thus can save cost for heating by warm air.

Furthermore, another object of the present invention is to provide a heater for indoor warming using exhaust waste heat which uses exhaust waste heat of a water heater for indoor warming to supply warm air for indoor warming and thus sharply saves cost for installing of facilities and cost for maintenance and increases thermal efficiency.

Furthermore, another object of the present invention is to provide a heater for indoor warming using exhaust waste heat which can minimize the consumption of power by disposing a temperature-sensing unit for sensing a temperature of the exhaust gas in the forced exhaust pipe and automatically operating and stopping a blower for forced exhaust and a blower for circulation of warm air depending on the temperature of the exhaust gas.

In addition, yet another object of the present invention is provide a heater for indoor warming using exhaust waste heat which minimizes loss of thermal efficiency due to increase of internal temperature of a exhaust heat exchanger as a whole, thereby enhancing the efficiency of heat exchange, by lengthening a time period of stay of high-temperature exhaust gas in the exhaust heat exchanger and thus can feed the warm air indoors in a short time.

Solution to the Problem

The present invention for achieving the above objects provides a heater for indoor warming using exhaust waste heat characterized in that the heater includes a natural exhaust pipe for naturally discharging part of exhaust gas introduced from a water heater; a forced exhaust pipe which is parallelly connected with the natural exhaust pipe and into which the rest of the exhaust gas except for the naturally-discharged exhaust gas flows; a heat-exchanging device which is arranged above the forced exhaust pipe and to which the exhaust gas of high temperature is fed; a blower for forced exhaust which is installed in an upper part of the heat-exchanging device and draws the exhaust gas from the forced exhaust pipe and discharges the same; a main body in which the heat-exchanging device is housed and installed and in which an external air-circulating section is defined where indoor air of low temperature circulates into the heat-exchanging device; a blower for circulation of warm air which feeds the indoor air of low temperature to the external air-circulating section and circulates the fed indoor air of low temperature to be heat-exchanged with the exhaust gas; and a control unit which drives and stops the blower for forced exhaust and the blower for circulation of warm air.

Furthermore, the present invention provides a heater for indoor warming using exhaust waste heat characterized in that the heater for indoor warming further includes a temperature-sensing unit which measures a temperature of the exhaust gas discharged from the water heater and transfers measured data to the control unit.

Furthermore, the present invention provides a heater for indoor warming using exhaust waste heat characterized in that the temperature-sensing unit includes a temperature-measuring device which measures the temperature of the exhaust gas passing through the natural exhaust pipe.

Furthermore, the present invention provides a heater for indoor warming using exhaust waste heat characterized in that the natural exhaust pipe naturally discharges 5% to 15% of the exhaust gas discharged from the water heater and the forced exhaust pipe feeds 85% to 95% of the exhaust gas to the heat-exchanging device by means of the blower for forced exhaust.

Furthermore, the present invention provides a heater for indoor warming using exhaust waste heat characterized in that the heater for indoor warming further includes an adjusting damper which adjusts the amount of the exhaust gas fed toward the natural exhaust pipe and the amount of the exhaust gas fed toward the forced exhaust pipe, depending on control of the control unit.

Furthermore, the present invention provides a heater for indoor warming using exhaust waste heat characterized in that the heat-exchanging device includes a waste gas introduction tank which is connected with the forced exhaust pipe and into which the exhaust gas flows; a plurality of heat exchange pipes which are arranged at a predetermined distance from each other above the waste gas introduction tank and which allows the exhaust gas drawn by the blower for forced exhaust to be heat-exchanged, by means of its temperature, with the indoor air of low temperature; a waste gas-discharging tank which is arranged above the heat exchange pipes in communication therewith and in which the heat-exchanged exhaust gas is charged; and a waste gas-discharging pipe which is installed in part of the waste gas-discharging tank and in which the blower for forced exhaust is installed in order to discharge the exhaust gas.

Furthermore, the present invention provides a heater for indoor warming using exhaust waste heat characterized in that further provided in a warm air-discharging pipe is multi-filter means which prevents fine particulates and various foreign matters from being fed indoors while entrained by the warm air when the warm air is discharged.

In addition, the present invention provides a heater for indoor warming using exhaust waste heat characterized in that the heater for indoor warming further includes a heat loss-preventing casing which encloses the main body and which allows the exhaust gas discharged to the natural exhaust pipe to circulate outside the main body to be fed to the heat-exchanging device.

Effects of the Invention

According to the present invention as described above, a forced exhaust pipe parallelly connected with a natural exhaust pipe of a water heater is provided and indoor air is heat-exchanged with exhaust gas introduced through the forced exhaust pipe and then the heat-exchange indoor air is fed back and also warm air is supplied without separate consumption of fuel for producing the warm air and thus an effect is shown that cost for heating by warm air can be saved.

Furthermore, according to the present invention, exhaust waste heat of a water heater for indoor warming is used to supply warm air for indoor warming and thus an effect is shown that cost for installing of facilities and cost for maintenance can be sharply saved.

Furthermore, according to the present invention, a temperature-sensing unit for sensing a temperature of the exhaust gas is disposed in the forced exhaust pipe and a blower for forced exhaust and a blower for circulation of warm air are automatically operated and stopped depending on the temperature of the exhaust gas and thus an effect is shown that the consumption of power can be minimized.

In addition, according to the present invention, an effect is shown that loss of thermal efficiency due to increase of internal temperature of a exhaust heat exchanger as a whole can be minimized, thereby enhancing the efficiency of heat exchange, by lengthening a time period of stay of high-temperature exhaust gas in the exhaust heat exchanger and thus the warm air can be fed indoors in a short time.

BEST MODES FOR CARRYING OUT THE INVENTION

Figure 1:
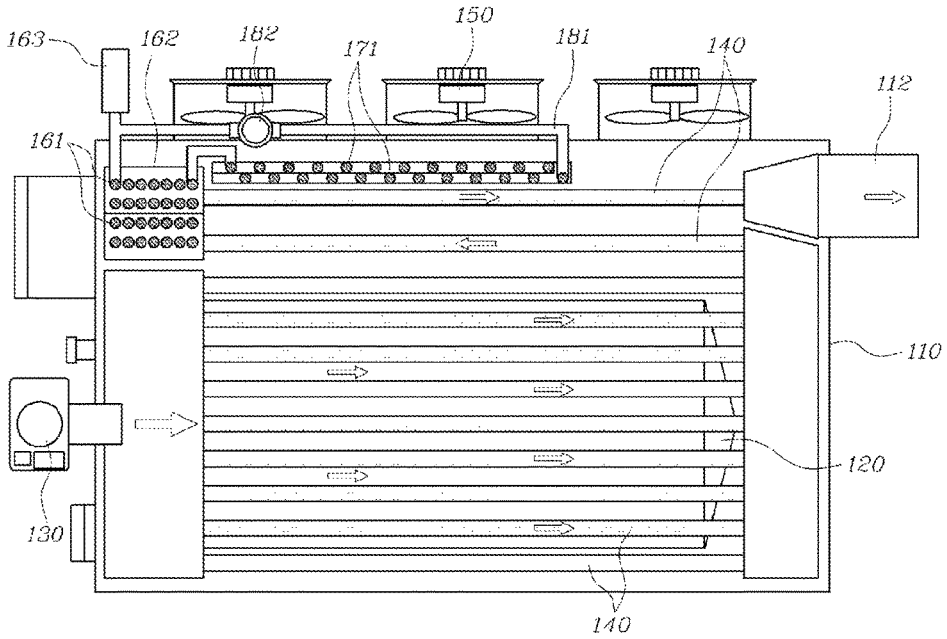
FIG. 1 is a view illustrating a warm-air heater having waste heat-recovering means according to prior art.

In the following, preferred embodiments of the present will be described in detail with reference to the attached drawings. First, regarding provision of reference numerals to constituent elements of each figure of the drawings, it should be noted that the same constituent elements have the same reference numerals, if possible, although the constituent elements are shown in different figures. In description of the present invention, if it is decided that detailed description of known related configurations or functions may obscure the gist of the present invention, the detailed description will be omitted.

Figure 2:
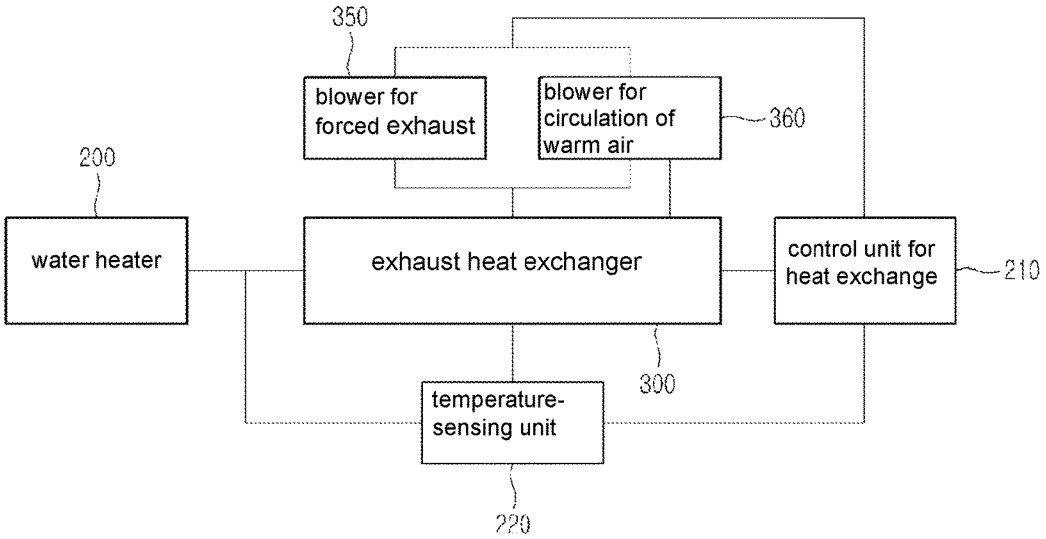
FIG. 2 is a constructional view schematically illustrating a heater for indoor warming using exhaust waste heat according to a preferred embodiment of the present invention.
Figure 3:
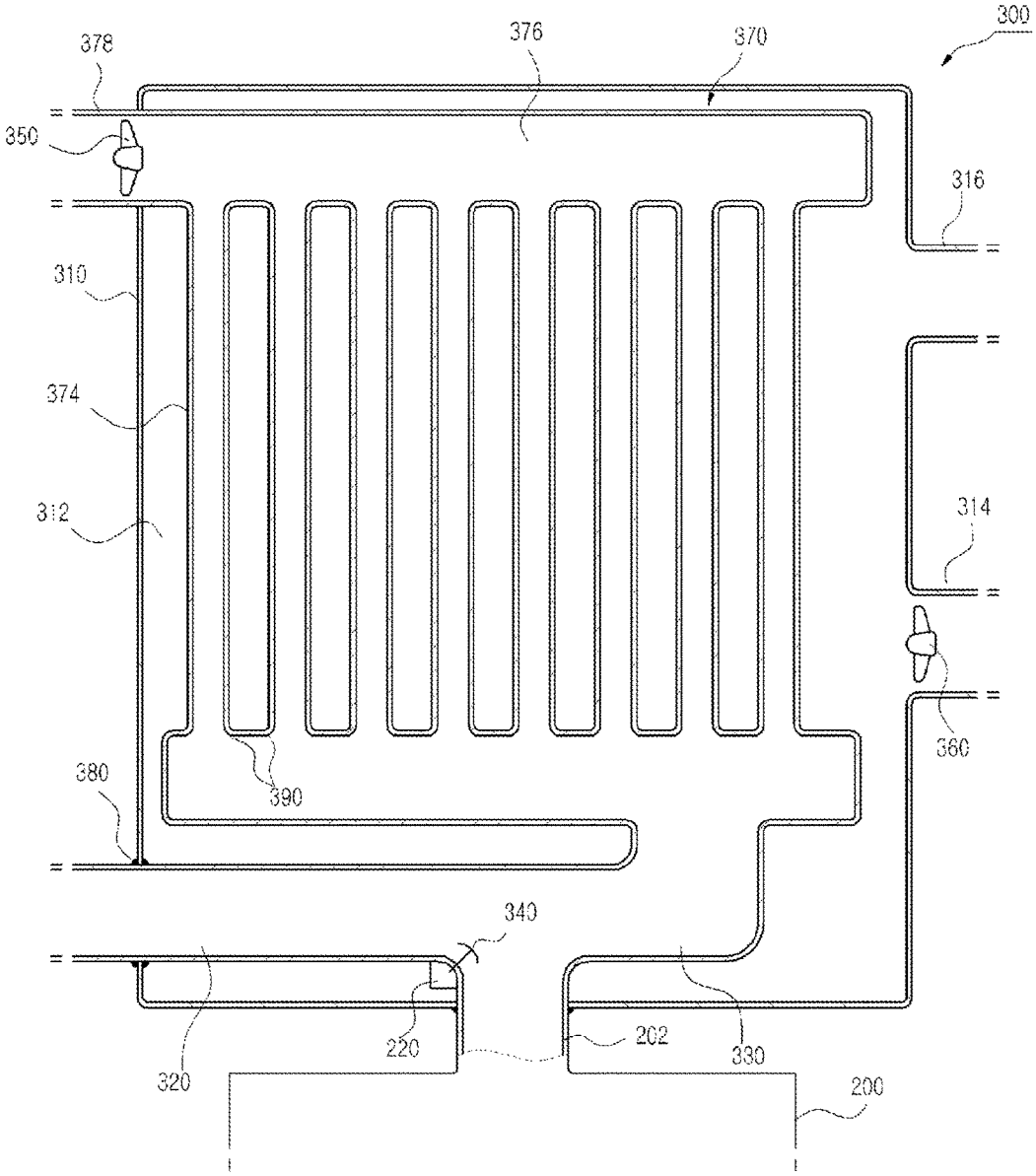
FIG. 3 is a view illustrating the heater for indoor warming using exhaust waste heat according to the preferred embodiment of the present invention.
Figure 4:
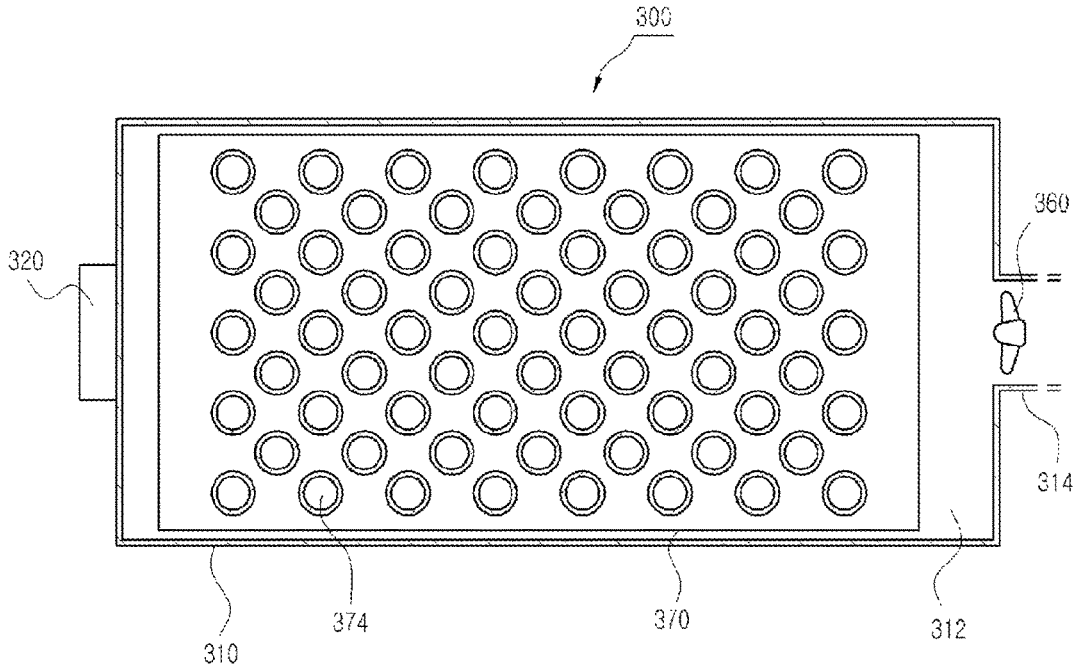
FIG. 4 is a view illustrating an exhaust heat exchanger of the heater for indoor warming using exhaust waste heat according to the preferred embodiment of the present invention.
Figure 5:
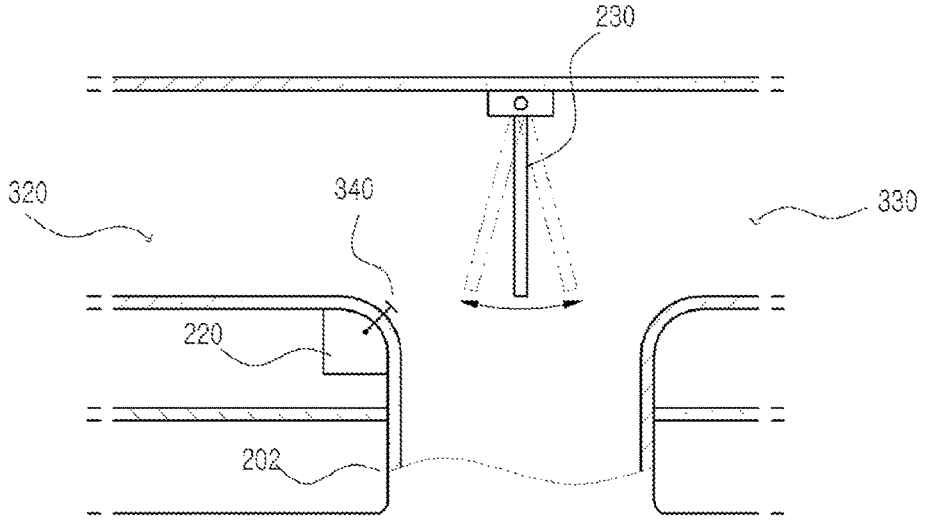
FIG. 5 is an enlarged view of a part of the exhaust heat exchanger according to the preferred embodiment of the present invention.
Figure 6:
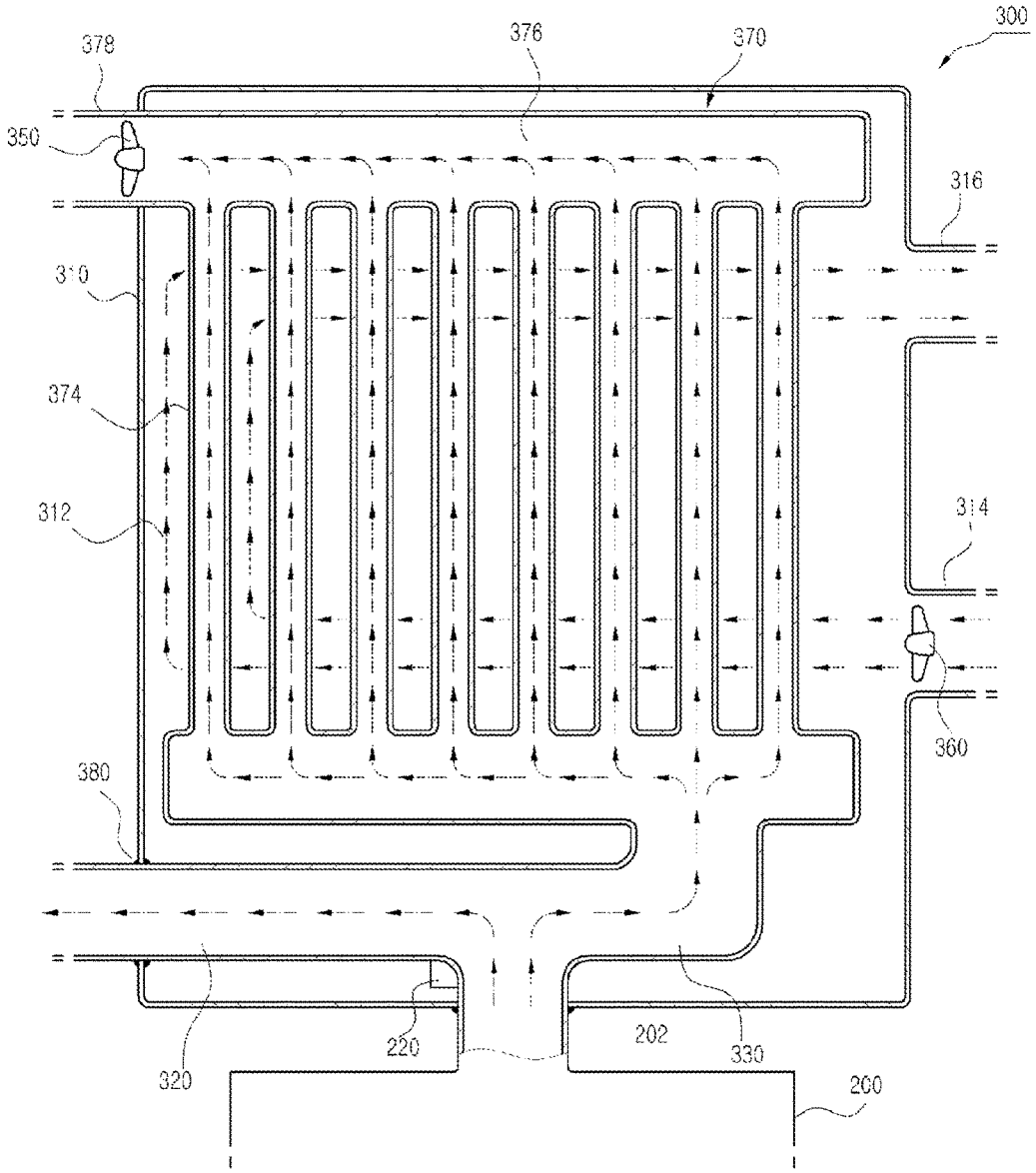
FIG. 6 is a view of an operational state of the exhaust heat exchanger according to the preferred embodiment of the present invention.
Figure 7:
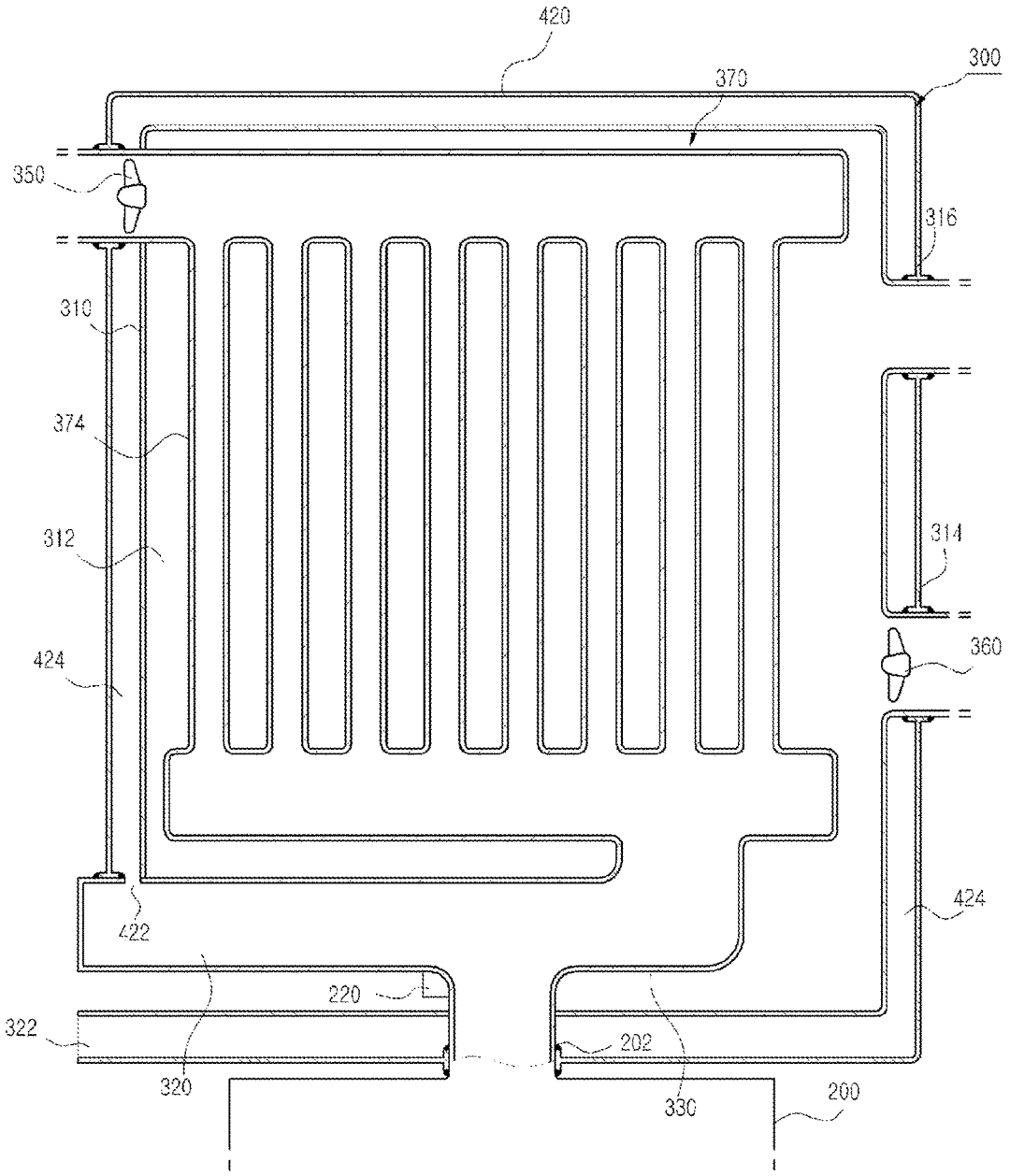
FIGS. 7 to 9 illustrate a heater for indoor warming using exhaust waste heat according to another embodiment of the present invention.
Figure 8:
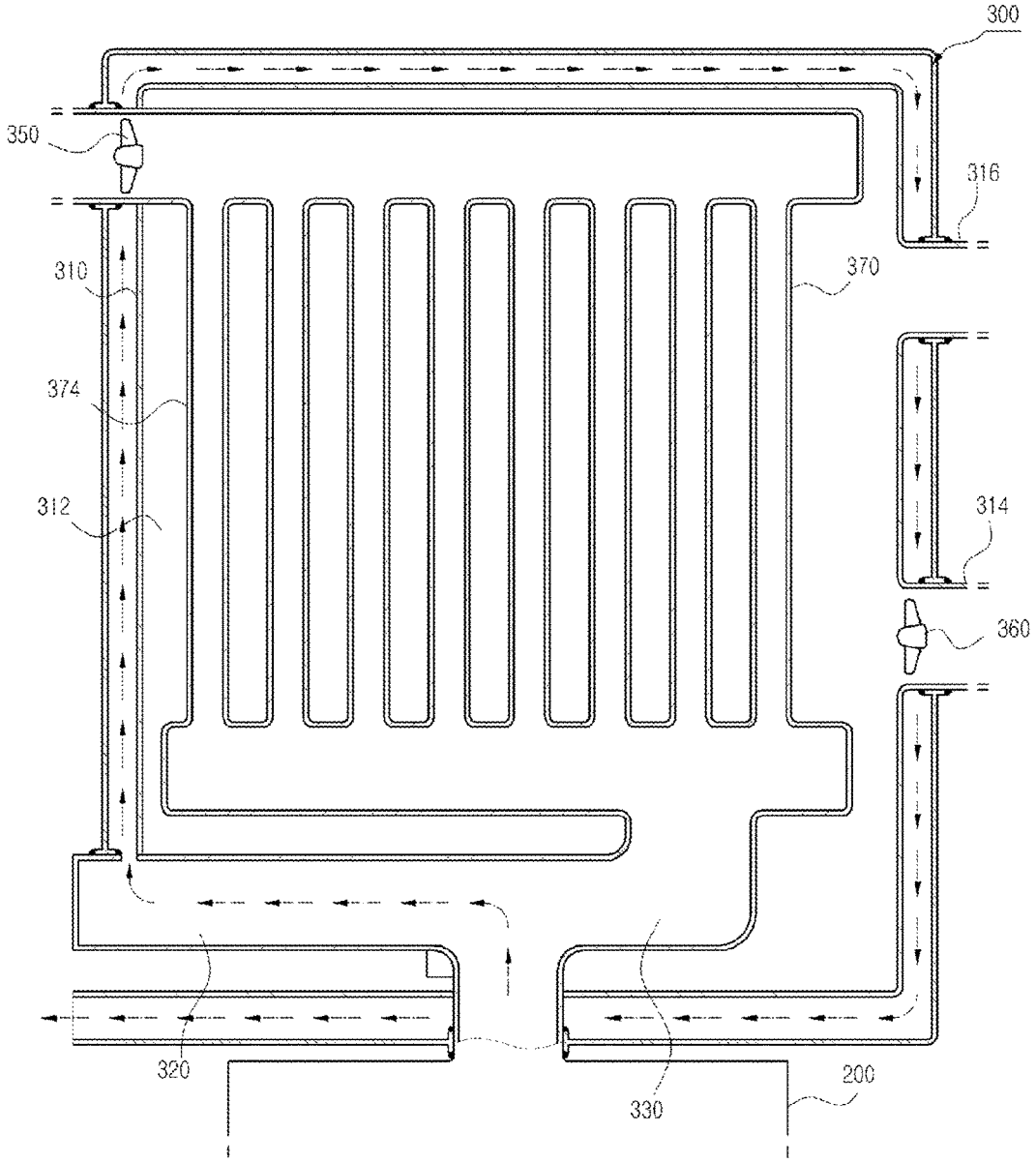
Figure 9:
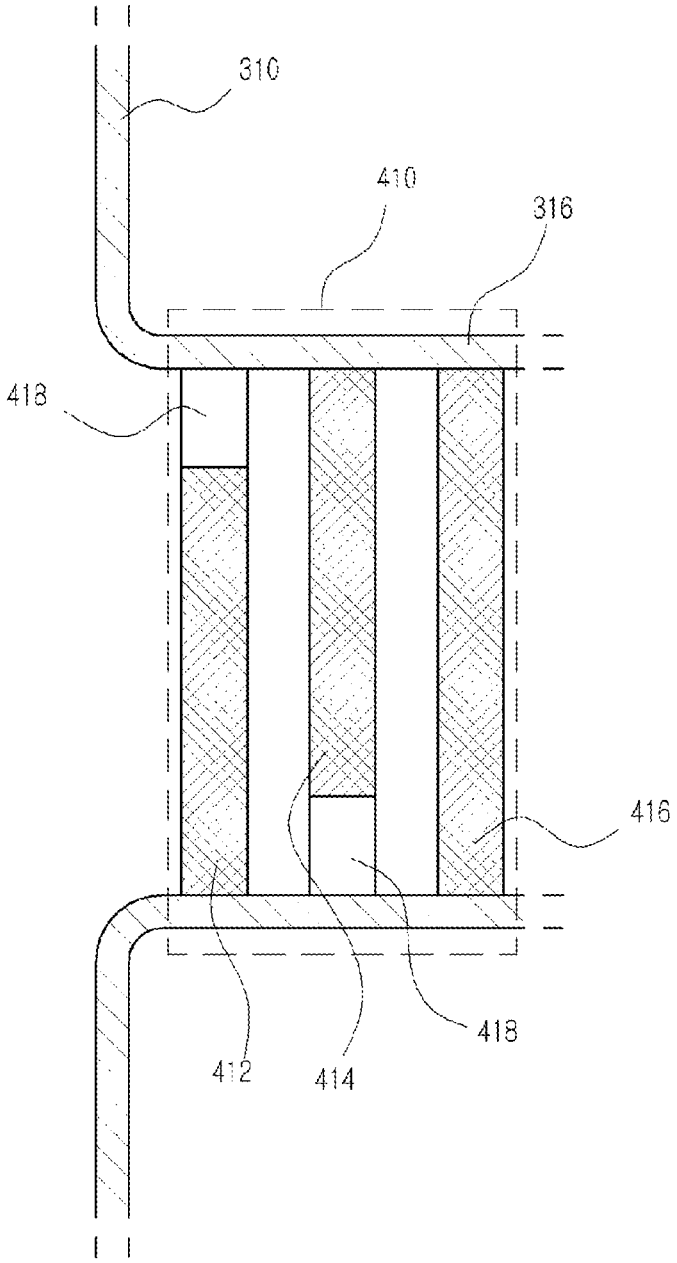

FIG. 2 is a constructional view schematically illustrating a heater for indoor warming using exhaust waste heat according to a preferred embodiment of the present invention, FIG. 3 is a view illustrating the heater for indoor warming using exhaust waste heat according to the preferred embodiment of the present invention, FIG. 4 is a view illustrating an exhaust heat exchanger of the heater for indoor warming using exhaust waste heat according to the preferred embodiment of the present invention, FIG. 5 is an enlarged view of a part of the exhaust heat exchanger according to the preferred embodiment of the present invention, FIG. 6 is a view of an operational state of the exhaust heat exchanger according to the preferred embodiment of the present invention, and FIGS. 7 to 9 illustrate a heater for indoor warming using exhaust waste heat according to another embodiment of the present invention.

As illustrated, a heater for indoor warming using exhaust waste heat according to the present invention includes an exhaust heat exchanger (300) which is connected with a discharge port (202) of a water heater for indoor warming (200) and which produces warm indoor air by allowing the exhaust gas discharged through the discharge port (202) to be heat-exchanged with external air.

As illustrated in FIG. 2, in such an heater for indoor warming, if the exhaust gas discharged from the water heater (200) is fed, a temperature of the exhaust gas is measured by a temperature-sensing unit (220) to be transferred to a control unit (210), and a blower for forced exhaust (350) and a blower for circulation of warm air (360) provided in the exhaust heat exchanger (300) are driven and stopped by the control unit (210) depending on the measured temperature.

Such a heater for indoor warming of the present invention performs heat exchange of the indoor air by means of the temperature of the exhaust gas to feed the indoor air back as warm air of high temperature, and supplies the warm air for indoor warming while driving or stopping each of the blowers by associated operation of the temperature-sensing unit (220) and the control unit (210).

As illustrated in FIGS. 3 to 6, the exhaust heat exchanger (300) includes a main body (310), a natural exhaust pipe (320), a forced exhaust pipe (330), a temperature-measuring device (340), the blower for forced exhaust (350), the blower for circulation of warm air (360), and a heat-exchanging device (370).

The heat-exchanging device (370) is housed and installed in the main body (310) such that the exhaust gas discharged from the water heater (200) flows into the heat exchange device, and an external air-circulating section (312) is defined by a predetermined space so that the heat exchange occurs while an external air circulates outside the heat-exchanging device (370).

Furthermore, a pipe for inflow of external air (314) through which the external air flows into one side of the main body (310) and a warm air-discharging pipe (316) through which the heat-exchanged external air is discharged are formed at a predetermined distance from each other.

Herein, the pipe for inflow of external air (314) is formed at a lower portion of the one side of the main body (310), and the warm air-discharging pipe (316) is formed above the pipe for inflow of external air (314) at a predetermined distance therefrom, preferably while positioned in line with the pipe for inflow of external air (314).

In other words, the external air whose temperature increase during the heat exchange becomes warm air and moves upwards, and the warm air which has been completely heat-exchanged can be naturally discharged through the warm air-discharging pipe (316) due to the wind speed and wind volume of the external air and temperature difference between before and after the heat exchange, without separate discharging power.

Meanwhile, as illustrated in FIG. 9, the warm air-discharging pipe (316) of the present invention may be further provided with multi-filter means (410) for filtering fine particulates.

The multi-filter means (410) is removably coupled with an end side of discharge port of the warm air-discharging pipe (316). The multi-filter means prevents the fine particulates and various foreign matters and the like flowing into the main body (310) from being discharged indoors while entrained by the warm air, and includes a first filter means (412), a second filter means (414) and a third filter means (416).

Herein, warm air passage holes (418) through which the warm air passes are preferably formed at upper portion of the first filter means (412) and at lower portion of the second filter means (414), respectively, to prevent occurrence of pressure difference between the external air-circulating section (312) and the warm air-discharging pipe (316); however, the present invention is not limited to it.

The natural exhaust pipe (320) is configured to be in communication with an upper end of the discharge port (202), and naturally discharges part of the exhaust gas introduced through a lower face of the other side of the main body (310) from the water heater (200). The temperature-sensing unit (220) for measuring the temperature of the flowing-in exhaust gas is provided on the natural exhaust pipe.

Such a natural exhaust pipe (320) is at its one end in communication with the forced exhaust pipe (330) and thus naturally discharges 5% to 15% of the exhaust gas of the water heater while allowing the exhaust gas fed from the water heater to flow toward the forced exhaust pipe (330).

In other words, 85% to 95% of total amount of the fed exhaust gas is fed toward the forced exhaust pipe (330) and is heat-exchanged with the external air.

Herein, the amount of natural exhaust of the exhaust gas is determined depending on the temperature of the exhaust gas measured by the temperature-sensing unit (220) as illustrated in FIG. 5. Of course, between the natural exhaust pipe (320) and the forced exhaust pipe (330), an adjusting damper (230) may be further arranged which adjusts the amount of the exhaust gas fed toward the natural exhaust pipe (320) and the amount of the exhaust gas fed toward the forced exhaust pipe (330) while rotated under control of the control unit (210).

The forced exhaust pipe (330) is parallelly connected with the natural exhaust pipe for outdoor discharge and feeds the rest of the exhaust gas to the heat-exchanging device (370) except for the naturally-discharged exhaust gas Such a forced exhaust pipe (330) feeds the exhaust gas to the heat-exchanging device (370) depending on the drive of the blower for forced exhaust (350), and the amount of feed of the exhaust gas is determined depending on the temperature of the exhaust gas measured by the temperature-sensing unit (220).

The natural exhaust pipe (320) and the forced exhaust pipe (330) configured as above preferably have chamfered portions (390) for smooth movement of the exhaust gas, which portions are formed by rounding ends of the pipes. The chamfered portions can minimize occurrence of bottleneck phenomenon of the exhaust gas at a boundary between the natural exhaust pipe (320) and the discharge port (202) and a boundary between the forced exhaust pipe (330) and a waste gas introduction tank (372) forming the heat-exchanging device (370) due to feed pressure of the exhaust gas fed from the water heater (200).

Such chamfered portions (390) may be also formed at ends of heat exchange pipes (374) of the heat-exchanging device (370) described later to allow more smooth circulation and heat exchange of the external air.

The temperature-sensing unit (220) has a temperature-measuring device (340) which is disposed on a boundary between the natural exhaust pipe (320) and the discharge port (202) and which can measure the temperature of the exhaust gas of high temperature coming from the discharge port (202) of the water heater (200) when the exhaust gas passes through the natural exhaust pipe (320). The temperature-sensing unit transfers data measured by the temperature-measuring device (340) to the control unit (210), and accordingly, the blower for forced exhaust (350) and the blower for circulation of warm air (360) are driven and stopped.

Such a temperature-sensing unit (220) transfers the temperature data of the exhaust gas measured by the temperature-measuring device (340) to the control unit (210) in real time and provides a feed time at which the exhaust gas is fed as well as the temperature of the exhaust gas among the measured data, whereby setting can be made so that the heater for indoor warming is automatically driven depending on the control of the control unit (210).

The blower for forced exhaust (350) is formed at upper end of the other side of the main body (310) and is installed in a waste gas-discharging tank (376) of the heat-exchanging device (370) described later and provides a drawing force by which the exhaust gas fed from the water heater (200) is drawn into the heat-exchanging device (370), and discharges the heat-exchanged exhaust gas to the outside.

The blower for circulation of warm air (360) draws indoor air of low temperature, i.e., the external air and feeds the air to the external air-circulating section (312) of the main body (310) and at the same time circulates the indoor air of low temperature at a predetermined wind speed to be heat-exchanged with the exhaust gas, and also feeds the heat-exchanged external air, i.e., warm air back indoors.

In other words, the blower for circulation of warm air (360) operates in a direction of pushing the indoor air into the main body (310) of the heater for indoor warming according to the present invention, wherein the indoor air is heat-exchanged while being circulated around outer circumferential surfaces of the heat exchange pipes (374) of the heat-exchanging device (370) by feed pressure generated at this time and the heat-exchanged warm air can be discharged by the blower for circulation of warm air. Such blower for forced exhaust (350) and blower for circulation of warm air (360) are driven and stopped depending on the control of the control unit (210), and may be configured so that they are automatically driven and stopped at a fixed period or time based on data such as the temperature of exhaust gas obtained by the temperature-sensing unit (220) and the time of feed of the exhaust gas and the like.

The heat-exchanging device (370) is housed and installed in the main body (310) and supports an internal flow of the exhaust gas to allow the heat exchange between the exhaust gas and the external air. The heat exchange device includes the waste gas introduction tank (372) which is connected with the forced exhaust pipe (330) and into which the exhaust gas fed flows; a plurality of the heat exchange pipes (374) which are arranged with a predetermined distance from each other above the waste gas introduction tank (372) and allows the exhaust gas drawn by the blower for forced exhaust (350) to be heat-exchanged, by means of its temperature, with the external air circulating through the external air-circulating section (312); and a waste gas-discharging tank (376) which is arranged above the heat exchange pipes (374) in communication therewith and in which a waste gas-discharging pipe (378) is installed, in which waste gas-discharging pipe the blower for forced exhaust (350) is installed in order to discharge the exhaust gas which has been heat-exchanged.

The control unit (210) drives and stops the blower for forced exhaust (350) and the blower for circulation of warm air (360) depending on the temperature of the exhaust gas measured by the temperature-sensing unit (220), and controls rotational speeds of the blower for forced exhaust (350) and the blower for circulation of warm air (360) to control the amount of feed of the exhaust gas and the amount of discharge of the warm air which has been heat-exchanged.

Furthermore, the control unit (210) of the present invention determines the amount of natural exhaust of the exhaust gas and the amount of forced exhaust for heat exchange, and also controls the operation of the adjusting damper (230) depending on the determined amount of the exhaust gas.

Meanwhile, it is preferable that leakage-preventing members (380) are provided at joints of constituent elements of the present invention for the purpose of preventing leakage of the exhaust gas, the external air and the warm air. Herein, the leakage-preventing members (380) may be formed by fusion of portions at which panels are connected to each other by welding and the like.

In addition, as illustrated in FIGS. 7 and 8, the heater for indoor warming according to the present invention may further includes a heat loss-preventing casing (420) which encloses the main body (310) at a predetermined distance therefrom and which allows the exhaust gas flowing toward the natural exhaust pipe (320) to circulate along outer wall surface of the main body (310).

The heat loss-preventing casing (420) is configured so that its inner wall surface has a predetermined distance from the outer wall surface of the main body (310), and thus the exhaust gas flowing toward the natural exhaust pipe (320) circulates along the outer wall surface of the main body (310) to be then discharged, whereby the heat of the exhaust gas fed to the heat-exchanging device (370) is prevented from being lost by external temperature and thus the efficiency of heat exchange between the exhaust gas and the indoor air of low temperature is further enhanced.

Such a heat loss-preventing casing (420) defines a gas circulation section (424) allowing the circulation of the exhaust gas along the outer wall surface of the main body (310), and a feed hole (422) which is formed in a portion of upper part of the natural exhaust pipe (320) exposed to the outside of the main body (310) and which feeds the d exhaust gas fed to the natural exhaust pipe (320) to the gas circulation section (424).

Furthermore, a discharge pipe (322) for outward discharge of the exhaust gas circulation of which has been completed is formed below the heat loss-preventing casing (420). The exhaust gas fed from the natural exhaust pipe (320) circulates to an upper side of the main body (310) and at this time, the main body (310) is prevented from losing its heat to an external temperature, by the temperature of the exhaust gas. The exhaust gas circulation of which has been completed, i.e., the exhaust gas which has been heat-exchange with the external temperature, is discharged through the discharge pipe (322).

In the heater for indoor warming configured as above, if the exhaust gas is discharged from the domestic gas water heater (200) at a temperature of 98° C. and at a wind volume of 3.56 $m^3$/min, 10% of the exhaust gas is discharged through the natural exhaust pipe (320) and the rest 90% flows into the heat-exchanging device (370) through the forced exhaust pipe (330).

At this time, the exhaust gas discharged through the forced exhaust pipe (330) is discharged at a temperature of 45° C. to 50° C. to flow into the heat-exchanging device (370) and is introduced by the blower for forced exhaust (350) at the volume of 2.77 $m^3$/min.

Also, the indoor air flows into the main body (310) at a temperature of 8° C. to 12° C. and becomes heated air of 40°

C. through the heat exchange with the exhaust gas and then is discharged through the warm air-discharging pipe (316). At this time, the wind speed of the discharged warm air is 12.3 m/sec and its wind volume is 5.8 $m^3$/min.

In the present invention as described above, the forced exhaust pipe (330) is arranged in parallel to the natural exhaust pipe (320) installed at the discharge port (202) of the water heater (200), and the natural exhaust pipe (320) performs a function of natural exhaust and at the same time the temperature-sensing unit (220) and the control unit (210) operates and stops the blower for forced exhaust (350) and the blower for circulation of warm air (360), whereby the warm air for indoor warming is supplied using the exhaust waste heat of the water heater for indoor warming.

The above description is merely an exemplary description of the technical concept of the present invention, and those skilled in the art may make various modifications and alterations without departing from the essential characteristics of the present invention. Therefore, the embodiments disclosed in the present invention are not intended to limit the technical concept of the present invention, rather are for illustration, and the scope of technical concept of the present invention is not limited by those embodiments. The scope of protection of the present invention should be construed by the following claims, and all technical concepts within a scope equivalent thereto should be considered to be included in the scope of right of the present invention.

LIST OF REFERENCE NUMERALS

200: water heater
210: control unit
220: temperature-sensing unit
300: exhaust heat exchanger
310: main body
320: natural exhaust pipe
330: forced exhaust pipe
340: temperature-measuring device
350: blower for forced exhaust
360: blower for circulation of warm air
370: heat-exchanging device

What is claimed is:

1. A heater for indoor warming using exhaust waste heat, comprising:

a natural exhaust pipe connected with a discharge port of a water heater for naturally discharging part of exhaust gas introduced from the water heater;

a forced exhaust pipe which is parallelly connected with the natural exhaust pipe and into which the rest of the exhaust gas except for the naturally-discharged exhaust gas flows;

a heat-exchanging device which is arranged above the forced exhaust pipe and to which the exhaust gas of high temperature is fed from the forced exhaust pipe;

a blower for forced exhaust which is installed in an upper part of the heat-exchanging device and draws the exhaust gas from the forced exhaust pipe and discharges the same;

a main body which encloses the heat-exchanging device and which an external air-circulating section is defined where indoor air of low temperature circulates while exchanging heat with the heat-exchanging device in the main body;

a blower for circulation of warm air which feeds the indoor air of low temperature to the external air-circulating section and circulates the fed indoor air of low temperature to be heat-exchanged with the rest of the exhaust gas passing through the forced exhaust pipe and the heat-exchanging device; and a heat loss-preventing casing which encloses the main body and defines an exhaust gas discharging path formed between the main body and the heat loss-preventing casing and being in fluid-communication with the natural exhaust pipe such that the part of the exhaust gas discharged to the natural exhaust pipe circulates outside the main body through the exhaust gas discharging path while exchanging heat with the fed indoor air of low temperature before being discharged from the heat loss-preventing casing.

2. The heater for indoor warming using exhaust waste heat according to claim 1, wherein the heater for indoor warming further comprises a temperature sensor which measures a temperature of the exhaust gas discharged from the water heater and passing through the natural exhaust pipe.

3. The heater for indoor warming using exhaust waste heat according to claim 1, wherein the natural exhaust pipe naturally discharges 5% to 15% of the exhaust gas discharged from the water heater and the forced exhaust pipe feeds 85% to 95% of the exhaust gas to the heat-exchanging device by means of the blower for forced exhaust.

4. The heater for indoor warming using exhaust waste heat according to claim 1, wherein the heater for indoor warming further comprises an adjusting damper which adjusts the amount of the exhaust gas fed toward the natural exhaust pipe and the amount of the exhaust gas fed toward the forced exhaust pipe.

5. The heater for indoor warming using exhaust waste heat according to claim 1, wherein the heat-exchanging device comprises:

a waste gas introduction tank which is connected with the forced exhaust pipe and into which the exhaust gas flows;

a plurality of heat exchange pipes which are arranged at a predetermined distance from each other above the waste gas introduction tank and which allows the exhaust gas drawn by the blower for forced exhaust to be heat-exchanged, by means of its temperature, with the indoor air of low temperature;

a waste gas-discharging tank which is arranged above the heat exchange pipes in communication therewith and in which the heat-exchanged exhaust gas is charged; and a waste gas-discharging pipe which is installed in part of the waste gas-discharging tank and in which the blower for forced exhaust is installed in order to discharge the exhaust gas.

6. The heater for indoor warming using exhaust waste heat according to claim 1, further comprising multi-filters which prevent fine particulates and various foreign matters from being fed indoors while entrained by the warm air when the warm air is discharged.

* * * * *